US009446869B2

(12) United States Patent
Foltz

(10) Patent No.: US 9,446,869 B2
(45) Date of Patent: Sep. 20, 2016

(54) PACKAGING BAND AND ASSOCIATED PACKAGED PRODUCT

(71) Applicant: TARGET BRANDS, INC., Minneapolis, MN (US)

(72) Inventor: Peter Foltz, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 130 days.

(21) Appl. No.: 14/176,395

(22) Filed: Feb. 10, 2014

(65) Prior Publication Data

US 2015/0225153 A1 Aug. 13, 2015

(51) Int. Cl.

| | |
|---|---|
| ***B65D 71/00*** | (2006.01) |
| ***B65B 11/00*** | (2006.01) |
| ***B65D 71/50*** | (2006.01) |
| ***B65D 75/02*** | (2006.01) |

(52) U.S. Cl.

CPC ..... *B65B 11/00* (2013.01); *B65D 71/50* (2013.01); *B65D 75/02* (2013.01)

(58) Field of Classification Search

CPC ..... B65D 71/06; B65D 71/36; B65D 75/02; B65D 75/46; B65D 75/54; B65D 75/545; B65D 75/14; B65D 75/52; G09F 1/10; B65B 11/00; A47F 7/143; B42F 5/06

See application file for complete search history.

(56) References Cited

U.S. PATENT DOCUMENTS

| | | | | | |
|---|---|---|---|---|---|
| 1,632,185 | A | * | 6/1927 | Jenner | B42D 15/042 229/92.8 |
| 1,676,492 | A | | 7/1928 | Goodwin | |
| 1,779,335 | A | * | 10/1930 | Remrey | A47G 19/30 206/449 |
| 1,812,077 | A | | 6/1931 | Belash | |
| 1,850,362 | A | * | 3/1932 | Vogel | A47F 7/143 196/14.52 |
| 1,896,573 | A | * | 2/1933 | Buxton | B42F 13/02 206/37 |
| 3,847,282 | A | * | 11/1974 | Collura | B65D 77/044 206/476 |
| 3,851,762 | A | | 12/1974 | Liblick | |
| 4,590,610 | A | | 5/1986 | Rhyne | |
| 4,869,007 | A | * | 9/1989 | Fast | G09F 1/10 40/617 |
| 5,050,735 | A | * | 9/1991 | Levy | A61B 10/0096 206/363 |
| 5,176,257 | A | * | 1/1993 | Levy | A61B 10/0096 206/456 |
| 5,257,694 | A | | 11/1993 | Wallach | |
| 5,344,003 | A | | 9/1994 | Park | |

(Continued)

OTHER PUBLICATIONS

Office Action from Canadian Patent Application No. 2,847,127, mailed Jun. 12, 2014 (2 pages).

(Continued)

*Primary Examiner* — Anthony Stashick
*Assistant Examiner* — James Way
(74) *Attorney, Agent, or Firm* — JoAnn M. Seaton; Griffiths & Seaton PLLC

(57) ABSTRACT

A packaging band includes side edges, a divider fold line, a front panel extending in a first direction away from the divider fold line, and a rear panel extending in a second direction away from the divider fold line. The packaging band includes a front securement tab and a rear securement tab. The front securement tab is formed in the front panel and flexes relative to the front panel about a front panel fold line. The rear securement tab is formed in the rear panel and flexes relative to the rear panel about a rear panel fold line. The front securement tab and the rear securement tab each rotate about a corresponding one of the front panel fold line and the rear panel fold line to open toward a same one of the first direction and the second direction when the packaging band is laid substantially flat.

23 Claims, 12 Drawing Sheets

(56) References Cited

U.S. PATENT DOCUMENTS

| | | | | |
|---|---|---|---|---|
| 5,611,433 | A * | 3/1997 | Levy | A61B 10/0096 206/569 |
| 5,791,470 | A * | 8/1998 | Usui | B65D 73/0014 206/362.4 |
| D412,110 | S | 7/1999 | Cornwell | |
| 6,308,842 | B1 | 10/2001 | Robbins, III et al. | |
| D475,283 | S | 6/2003 | Haboush | |
| D694,123 | S * | 11/2013 | Bowman | D9/711 |
| 9,033,150 | B2 * | 5/2015 | Andrich | B31B 1/74 206/378 |
| 2002/0029995 | A1 | 3/2002 | Garrett | |
| 2002/0063078 | A1 | 5/2002 | Garrett | |
| 2007/0051864 | A1 | 3/2007 | Bartell et al. | |

OTHER PUBLICATIONS

Office Action from Canadian Patent Application No. 2,847,127, mailed Oct. 9, 2014 (3 pages).

* cited by examiner

PACKAGING BAND AND ASSOCIATED PACKAGED PRODUCT

BACKGROUND OF THE INVENTION

Retail packaging is a continuously evolving and important part of retail product provision as well as marketing for those products. As green initiatives grow, packaging trends move toward using recyclable materials and/or simpler packaging options. In addition, when manufacturing products, even relatively small cost savings per package obtained by either using less material, simplified packaging assembly, simplified coupling of products to packaging, etc. are substantial when multiplied by the thousands, hundreds of thousands, or even higher quantities of a package run for a particular product offering.

The desire for cost savings and green solutions is counterbalanced against a desire for the packaging to provide an aesthetically pleasing look while additionally providing areas to receive copy describing the product, brand, preferred use, etc. Packaging is often the first and/or most direct line of marketing to potential consumer, which increases the importance of packaged product aesthetics.

SUMMARY OF THE INVENTION

One aspect of the present invention relates to a packaging band including two opposing side edges, a divider fold line extending between and contacting each of the two opposing side edges, a front panel extending in a first direction away from the divider fold line, and a rear panel extending in a second direction away from the divider fold line. The packaging band further includes at least one front securement tab and at least one rear securement tab. The at least one front securement tab is formed in an interior of the front panel and is configured to flex relative to a remainder of the front panel about a front panel fold line defined in the front panel. The at least one rear securement tab is formed in an interior of the rear panel and is configured to flex relative to a remainder of the rear panel about a rear panel fold line. The at least one front securement tab and the at least one rear securement tab each rotate about a corresponding one of the front panel fold line and the rear panel fold line relative to a respective one of the remainder of the front panel and the remainder of the rear panel to open toward a same one of the first direction and the second direction when the packaging band is laid substantially flat. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
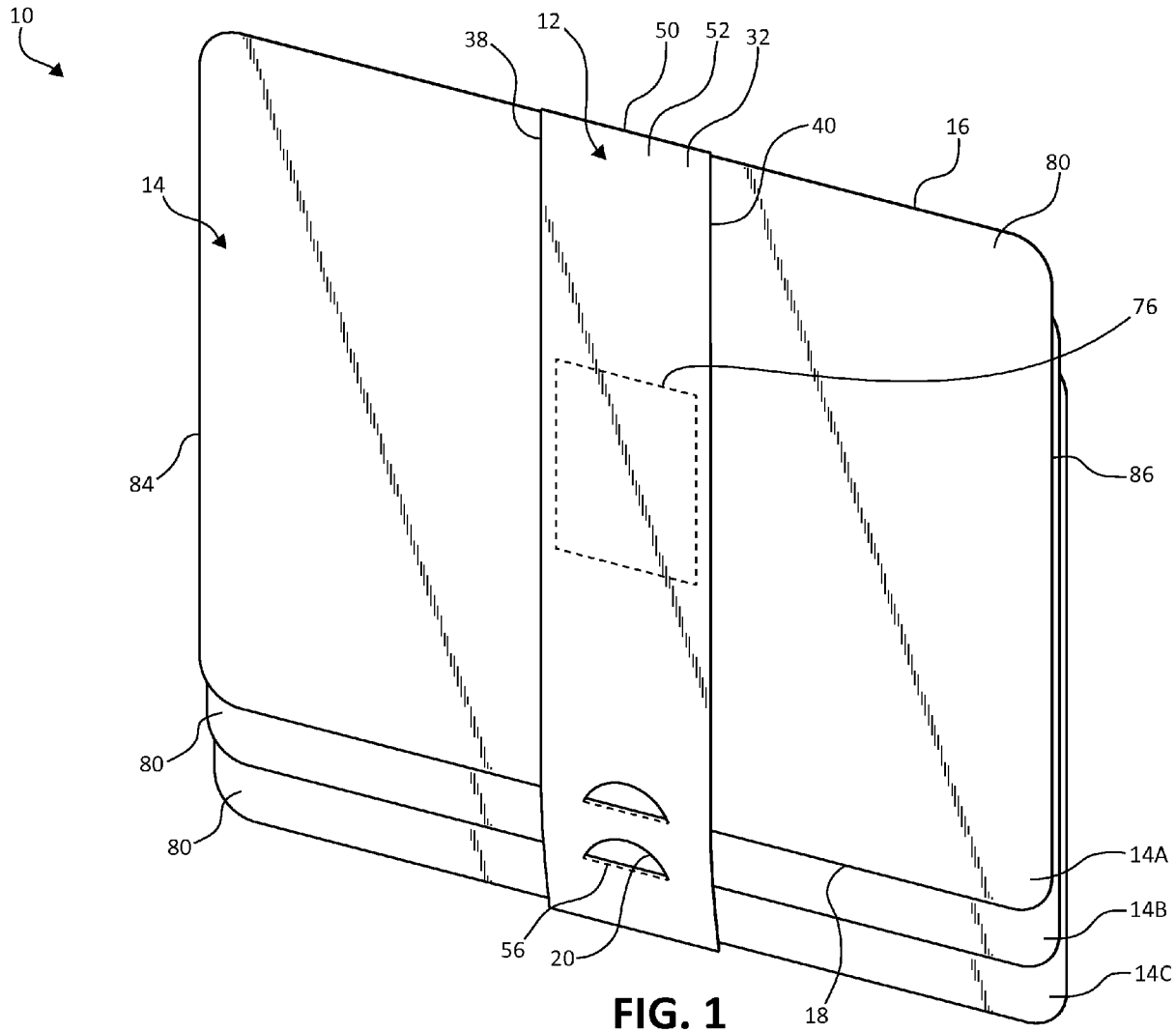
FIG. 1 is a front perspective view illustration of a packaged product including a packaging band and products, according to one embodiment of the present invention.
Figure 2:
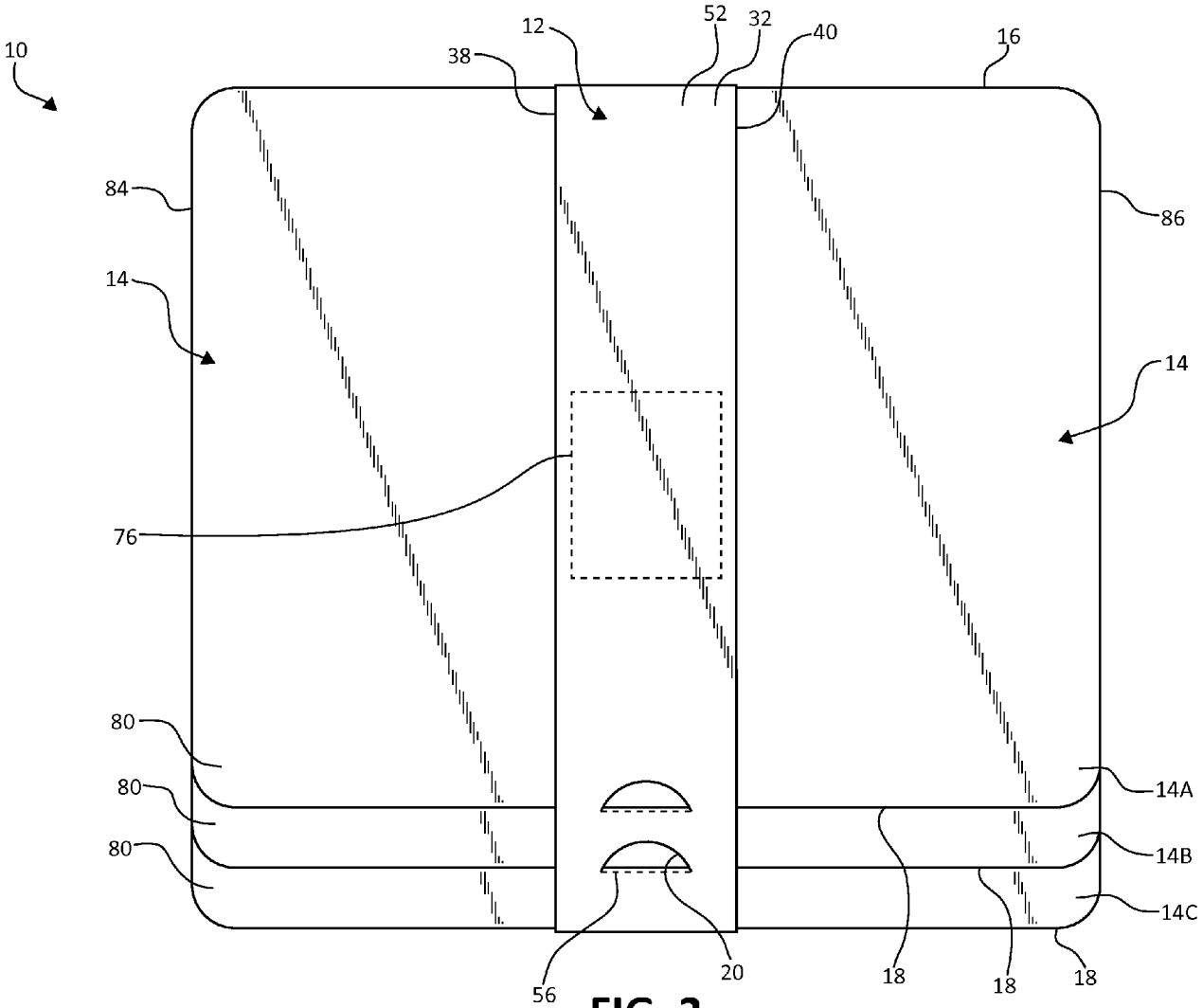
FIG. 2 is a front view illustration of the packaged product of FIG. 1, according to one embodiment of the present invention.
Figure 3:
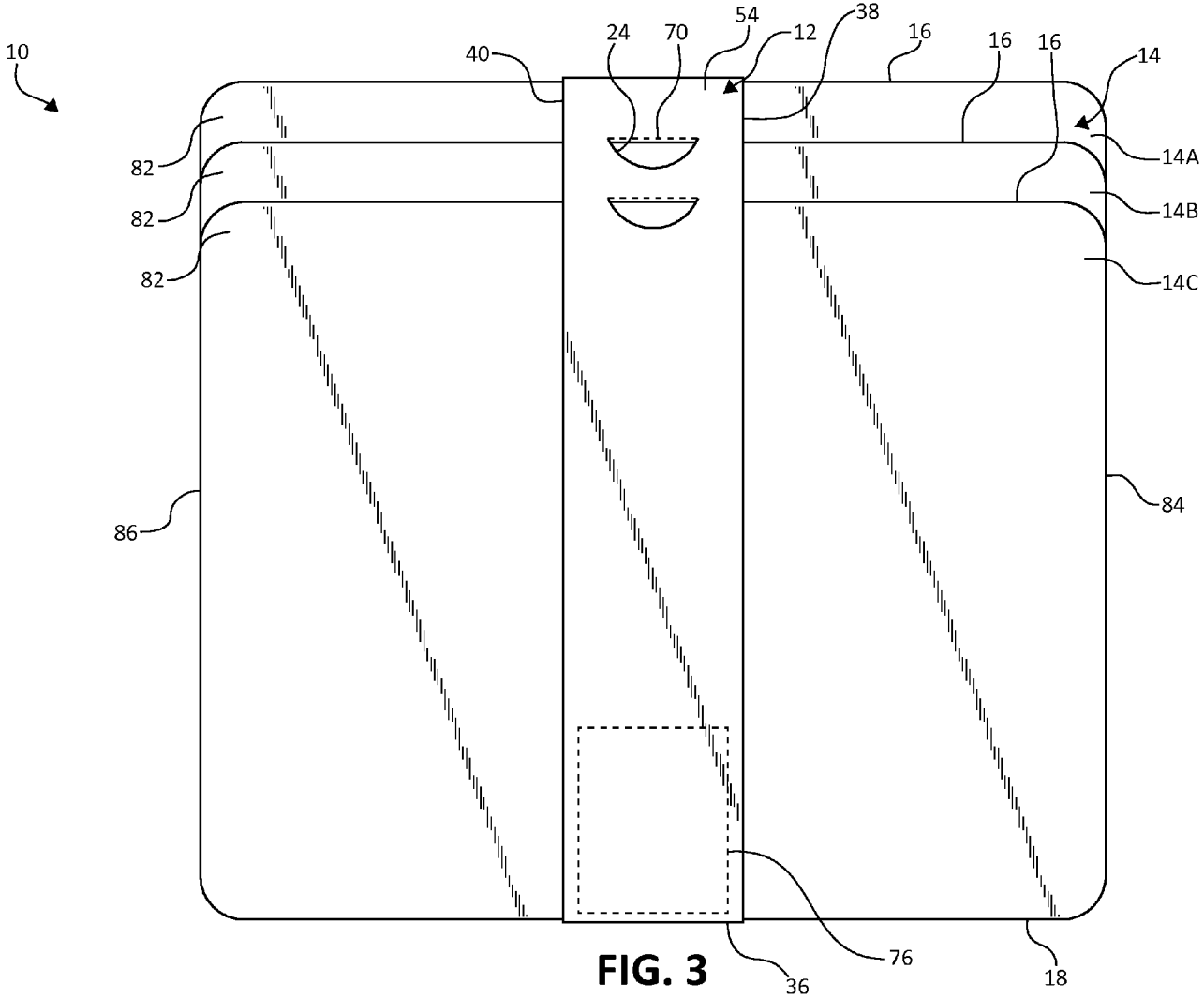
FIG. 3 is a rear view illustration of the packaged product of FIG. 1, according to one embodiment of the present invention.
Figure 5:
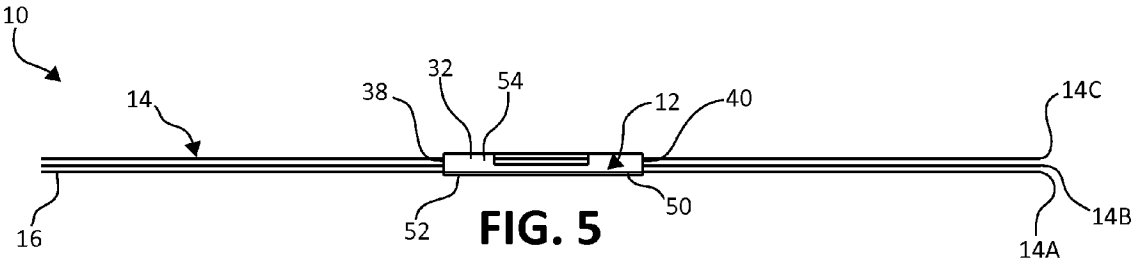
FIG. 5 is a top view illustration of the packaged product of FIG. 1, according to one embodiment of the present invention.
Figure 6:
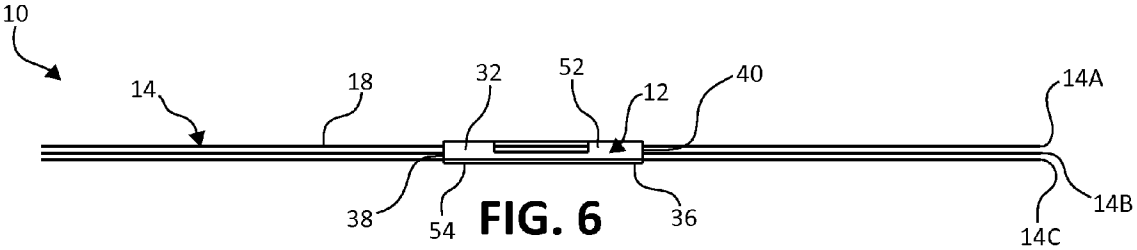
FIG. 6 is a bottom view illustration of the packaged product of FIG. 1, according to one embodiment of the present invention.
Figure 4:
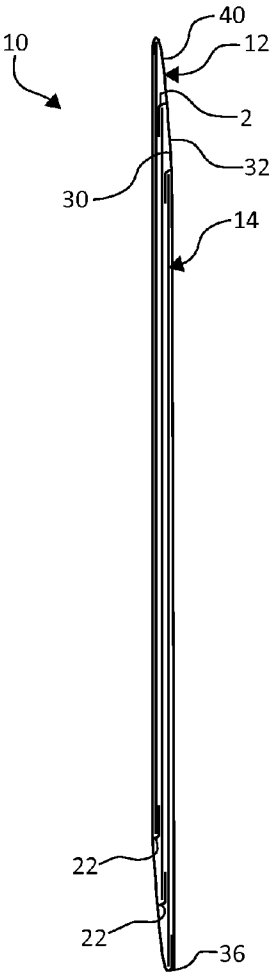
FIG. 4 is a right side view illustration of the packaged product of FIG. 1 with the left side view being a mirror image to the right side view, according to one embodiment of the present invention.

The present invention provides for a packaging band for maintaining a plurality of substantially planar items as part of a single packaged product offered for retail sale, gifting, etc. In one example, the packaging band encircles the plurality of products and interacts with opposing edges of the plurality of products in a manner independently maintaining each of the plurality of products at least slightly offset from others of the plurality of products. For example, the packaging band includes securement tabs at each of a front and a back of the packaging band that are each configured to interact with and maintain an edge of a single one of the plurality of products. In one embodiment, the product offset allows a user to view portions of all of the plurality of products maintained by the packaging band.

In one example, the packaging band is substantially narrower than the plurality of products such that a substantial portion of each of the plurality of products extends on either side thereof, thereby, allowing a user to view and/or interact with each of the plurality of products generally without dislodging any of the plurality of products from the packaging band. In one example, the plurality of products may not be substantially planar but do include substantially thin and/or planar opposing edges for interacting with the packaging band. The packaging band further may be formed of a readily recyclable material and utilizes a very small amount of material as compared to packages that fully enclose the products making the packaging band desirable from both a cost and environmental standpoint.

More specifically, FIGS. 1-6 illustrate a packaged product 10 including a packaging strip or packaging band 12 and a plurality of products 14, for example, a plurality of products 14A, 14B, and 14C, according to one embodiment of the present invention. Each of the plurality of products 14 is substantially identical in size and shape, in one example, and has relatively thin and/or substantially planar opposing edges such as a top edge 16 and a bottom edge 18. Packaging band 12 includes first or front panel cutouts 20 defining first or front securement tabs 22 and second or rear panel cutouts 24 defining second or rear securement tabs 26. Each of front securement tabs 22 and rear securement tabs 26 opens toward the other one of front securement tabs 22 and rear securement tabs 26.

At least one of top edge 16 and bottom edge 18 of each of the plurality of products 14 is secured by a different one of front securement tabs 22 and/or a different one of the rear securement tabs 26 in a manner maintaining each of the plurality of products 14 in place relative to other ones of the plurality of products 14 and packaging band 12. In one embodiment, front securement tabs 22 and rear securement tabs 26 are positioned relative to each other such that the plurality of products 14 are maintained in an offset stack within packaging band 14 as will be further described below.

Figure 7:
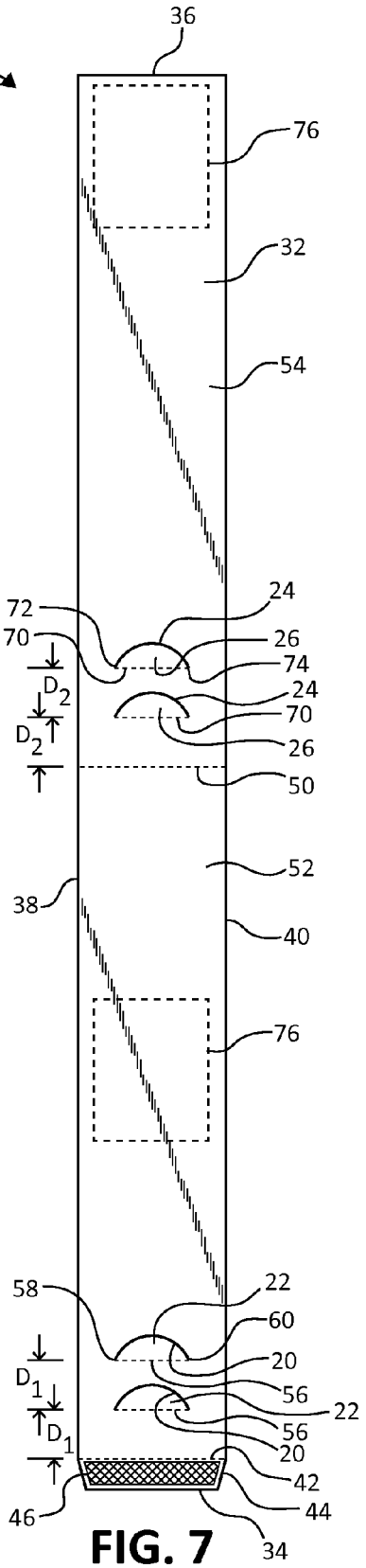
FIG. 7 is a front view illustration of an unfolded packaging band, according to one embodiment of the present invention.

FIG. 7 illustrates packaging band 12 in an unfolded or initial state. In one embodiment, packaging band 12 is cut from a single piece of a suitable and foldable planar material such as paperboard, cardboard, plastic, etc. in an elongated shape, such as a rectangular shape. As a substantially planar member, packaging band 12 defines an interior surface 30, an exterior surface 32 opposite interior surface 30, a first free end edge 34, a second free end edge 36 opposite first free end edge 34, and longitudinal side edges 38 and 40. Longitudinal side edges 38 and 40 each extend between first free end edge 34 and second free end edge 36 and are positioned opposite one another. In one example, first free end edge 34 and second free end edge 36 extend substantially parallel to one another and/or substantially perpendicular relative to longitudinal side edges 38 and 40. In an embodiment, longitudinal side edges 38 and 40 extend substantially parallel to one another and/or substantially perpendicular relative to first free end edge 34 and second free end edge 36.

A tab fold line 42 transversely extends across packaging band 12 near first free end edge 34 to define a coupling tab 44 therebetween. In one example, tab fold line 42 extends substantially parallel to first free end edge 34 and/or longitudinal side edges 38 and 40 taper toward one another as they near first free end edge 34. Adhesive 46, as indicated with hatching in FIG. 7, is applied to a portion of exterior surface 32 defined by coupling tab 44 to facilitate assembly of packaged product 10 of FIGS. 1-6. A divider fold line 50 extends transversely across packaging band 12 about midway between tab fold line 42 and second free end edge 36 to divide packaging band 12 into a first or front panel 52 and a second or rear panel 54. In one example, front panel 52 and rear panel 54 are formed with substantially identical lengths and/or have substantially identical overall sizes and/or shapes.

Each front securement tab 22 is formed in an interior of front panel 52 by a different corresponding one of front panel cutouts 20. More specifically, in one example, each front panel fold line 56 is positioned substantially entirely within an interior of front panel 52 substantially parallel to tab fold line 42 between a first end 58 and a second end 60 of front panel fold line 56. Front panel cutouts 20 each are formed in front panel 52 and extend from a corresponding first end 56 toward divider fold line 50 and back to a corresponding second end 58 to form front securement tab 22 between front fold line 54 and front panel cutouts 20. In one example, front panel cutouts 20 are each curvilinear and C-shaped while in other embodiments front panel cutouts are U-shaped, carrot shaped, serpentine shaped, etc. resulting in front securement tabs 22 that are one of substantially semi-circular in shape, rectangular in shape, triangular in shape, or otherwise suitably shaped.

In one example, front panel fold lines 56 and front securement tabs 22 are longitudinally spaced from one another, for instance a distance $D_1$ equal to a distance the one of front panel fold lines 56 closest to tab fold line 42 is spaced from the other front panel fold line 56 as shown in FIG. 7. In one embodiment, two front panel fold lines 56, and therefore, two front securement tabs 22 are formed in front panel 52. However, any number of front panel fold lines 56, for example, between one and five front panel fold lines 56, may be formed in front panel 52. In one example, the number of front panel fold lines 56 equals the number of products 14 included in packaged product 10 minus one (e.g., where the number of products is n, the number of front panel fold lines 56 is n−1). While specific spacing of front securement tabs 22 depends on desired display details for the plurality of products 14, such as the amount of desired reveal of each product 14 around other ones of products 14. In one example, front securement tabs 22 are positioned within about a half, or in one embodiment, within about a quarter, of front panel 52 adjacent tab fold line 42. In any such shape, front securement tabs 22 are configured to flex about the corresponding front panel fold line 54 away from exterior surface 32 immediately adjacent thereto. While front securement tabs 22 may sharply fold about a corresponding front panel fold line 54, in one example, front securement tabs 22 flexes slightly inwardly about fold line 54.

Figure 8:
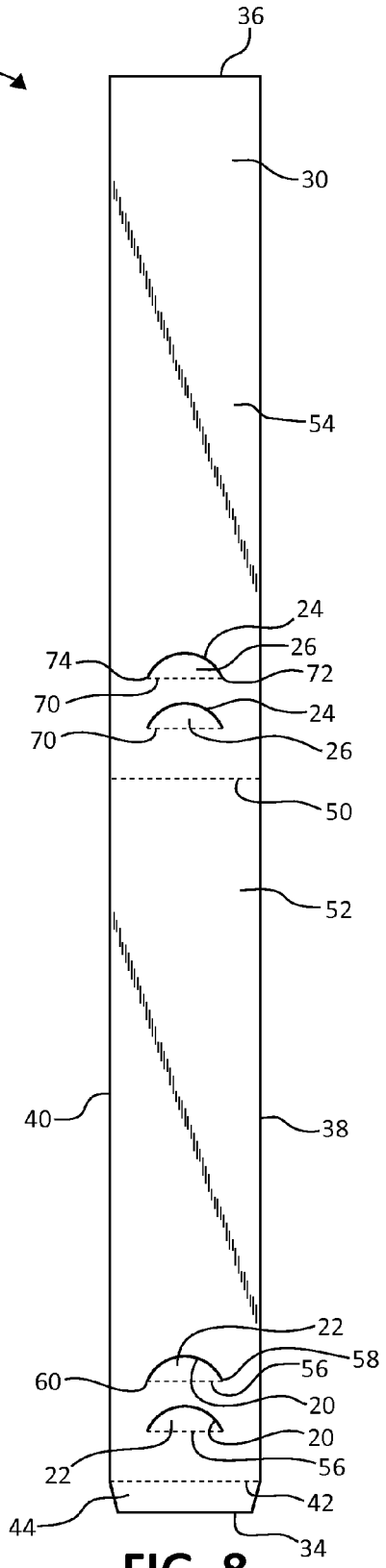
FIG. 8 is a rear view illustration of the unfolded packaging band of FIG. 7, according to one embodiment of the present invention.

Each rear securement tab 26 is formed in an interior of rear panel 54 by a different corresponding one of rear panel cutouts 24. More specifically, in one example, each rear panel fold line 70 is positioned substantially entirely in an interior of rear panel 54 and extends substantially parallel to tab fold line 42 between a first end 72 and a second end 74 of rear panel fold line 70. Rear panel cutouts 24 each are formed in rear panel 54 and extend from a corresponding first end 72 toward divider fold line 50 and back to a corresponding second end 74. As such, rear securement tab 26 is formed between rear fold line 70 and rear panel cutouts 24. In this manner, as shown in the illustrated embodiment of FIGS. 7 and 8, when packaging band 12 is unfolded, front panel cutouts 20 and rear panel cutouts 24 all extend in the same general direction (e.g., upwardly as illustrated) away from a corresponding one of front panel fold lines 56 and rear panel fold lines 70. In one example, rear panel cutouts 24 are each curvilinear and C-shaped while in other embodiments front panel cutouts are U-shaped, carrot shaped, serpentine shaped, etc. resulting in rear securement tabs 26 that are one of substantially semi-circular in shape, rectangular in shape, triangular in shape, or otherwise suitably shaped. In any such shape, rear panel cutouts 24 are configured to flex about the corresponding rear panel fold line 72 away from exterior surface 32 immediately adjacent thereto.

In one example, rear panel fold lines 72 and rear securement tabs 26 are longitudinally spaced from one another, for instance a distance $D_2$ equal to a distance the rear panel fold line 70 closest to divider fold line 50 is spaced from divider fold line 50 as shown in FIG. 7. Distance D1 is equal to distance D2, in one example. As illustrated, two rear panel fold lines 72, and therefore, two rear securement tabs 26 are formed in rear panel 54. However, any number of rear panel fold lines 72, for example between one and five rear panel fold lines 72 may be formed in rear panel 54. In one example, the number of rear panel fold lines 72 equals the number of front panel fold lines 56 and/or the number of products 14 included in packaged product 10 minus one (e.g., where the number of products is n, the number of rear panel fold lines 72 is n−1). While specific spacing of rear securement tabs 26 depends on desired display details for the plurality of products 14, in one example, rear securement tabs 26 are positioned within about a half, or in one embodiment, a quarter, of rear panel 54 adjacent divider fold line 50. In any such shape, rear panel cutouts 24 are configured to flex about the corresponding rear panel fold line 72 away from exterior surface 32 immediately adjacent thereto.

External surface 32 further includes indicia, as generally indicated by dashed boxes 76 in FIGS. 1-7 on one and/or both of front panel 52 and rear panel 54. Indicia 76 provide information about product 14 such as an associated brand, product description, size description, use description, point-of sale processing information (e.g., a bar code), marketing information, etc. for informing potential consumers about products 14 and/or for potentially persuading potential consumers to buy products 14.

Products 14 may take on any one of a variety of forms. In one example, products 14 are each substantially planar members such as cutting mats, artwork, folders, placemats, etc. and are each substantially identical in size and shape, or at least in thickness as compared to the other products 14. In FIGS. 1-6, three products 14A, 14B, and 14C are illustrated and are each substantially identical in size and shape such that the attributes described herein for each product 14 or one of products 14A, 14B, or 14C generally equally applies to others of products 14A, 14B, and 14C. In one example, each product 14 includes a front surface 80 and an opposing rear surface 82, which are each substantially planar. While each product 14 may take on various shapes, in one embodiment, where each product 14 is generally square or otherwise rectangular, each product 14 defines first or top edge 16, second or bottom edge 18, and opposing side edges 84 and 86 each extending between top edge 16 and bottom edge 18 opposite one another. Each product 14 has a height defined between top edge 16 and bottom edge 18 that is substantially equal to a distance between either one or all of a front panel fold line 56 and divider line 50, a different front panel fold line 56 and a corresponding one of rear panel fold lines 70, and a different rear panel fold line 70 and tab fold line 42, as will be further explained below.

During assembly, each of products 14 is secured to packaging band 12 via interaction with at least one of front securement tabs 22 and rear securement tabs 26. More specifically, in one embodiment, packaging band 12 is placed with exterior surface 54 down as illustrated for example, in FIG. 8. Bottom edge 18 of first product 14A is slid between a topmost one of front securement tabs 22 (e.g., the one of front securement tabs 22 closest to divider fold line 50) until bottom edge 18 rests near and substantially directly adjacent front panel fold line 56 of the topmost one of front securement tabs 22. In this manner, bottom edge 18 of first product 14A is held between a corresponding front securement tab 22 and a remainder of front panel 52. When so positioned, in one example, top edge 16 of first product 14A is positioned immediately adjacent divider fold line 50 of packaging band 12, such that a height of first product 14A is substantially equal to a distance between front panel fold line 56 of the topmost one of front securement tabs 22 and divider line 50.

Figure 10:
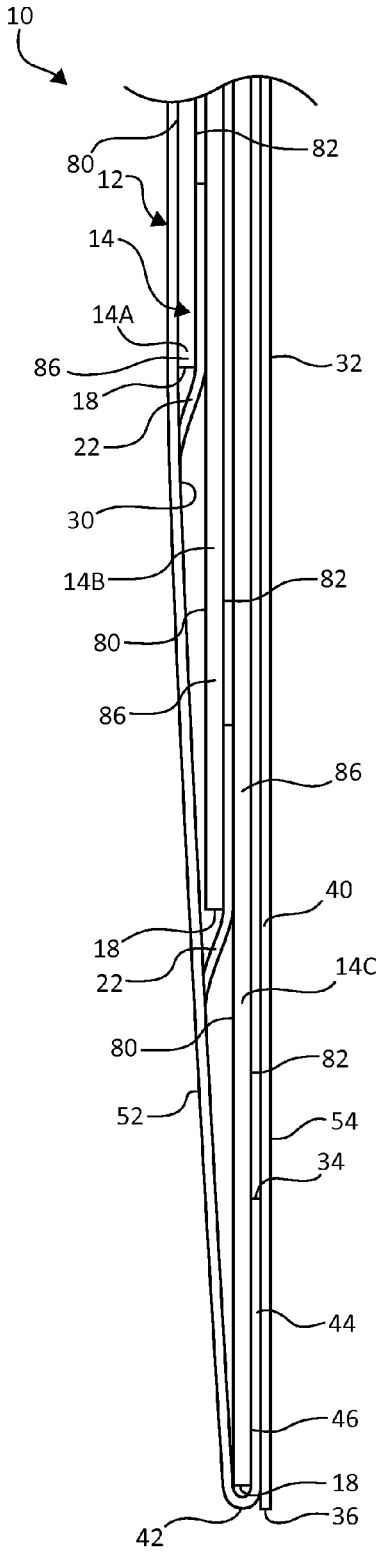
FIG. 10 is an enlarged bottom partial side view illustration of the packaged product of FIG. 1, according to one embodiment of the present invention.
Figure 11:
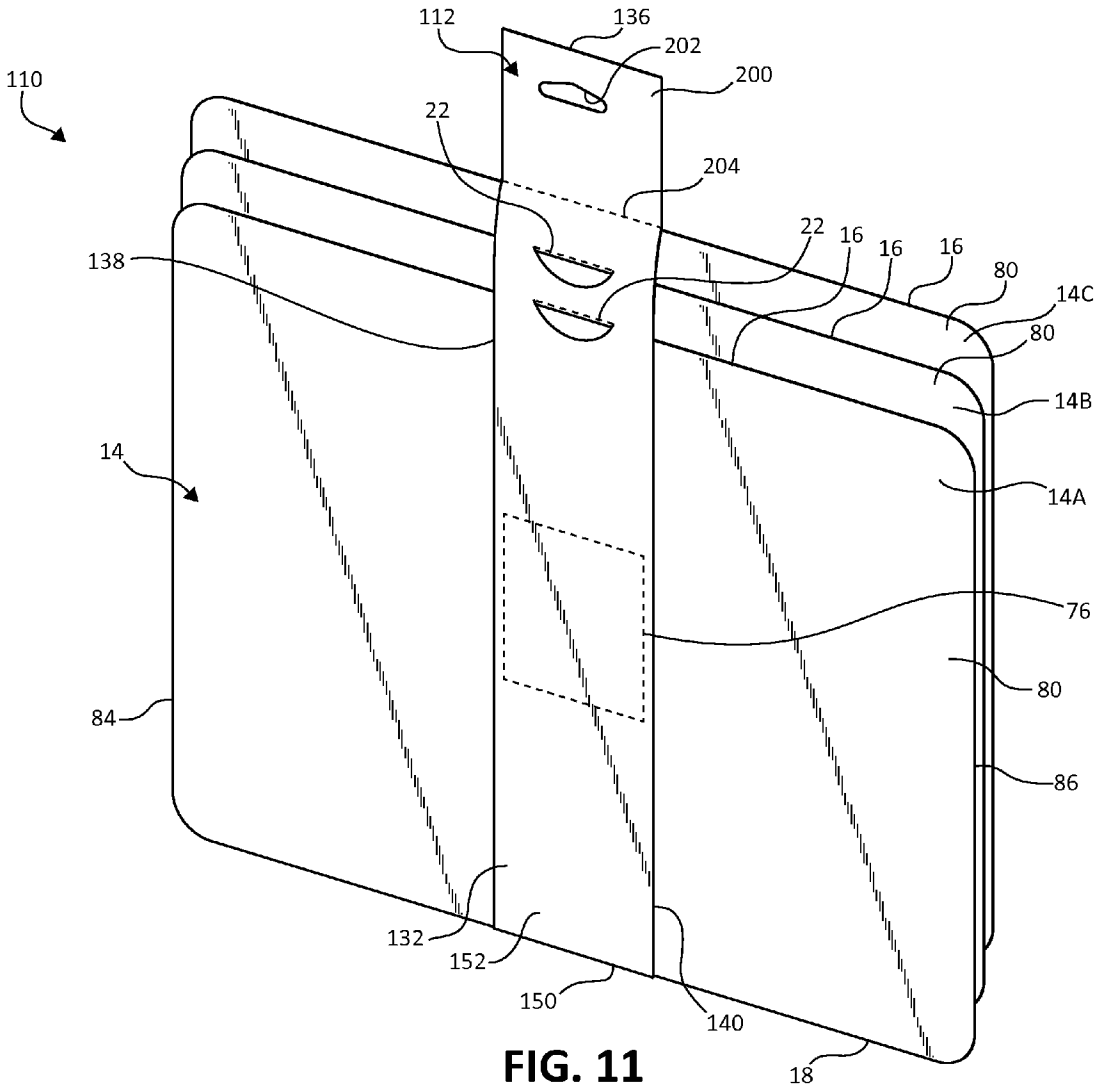
FIG. 11 is a front perspective view illustration of a packaged product including a packaging band and products, according to one embodiment of the present invention.
Figure 12:
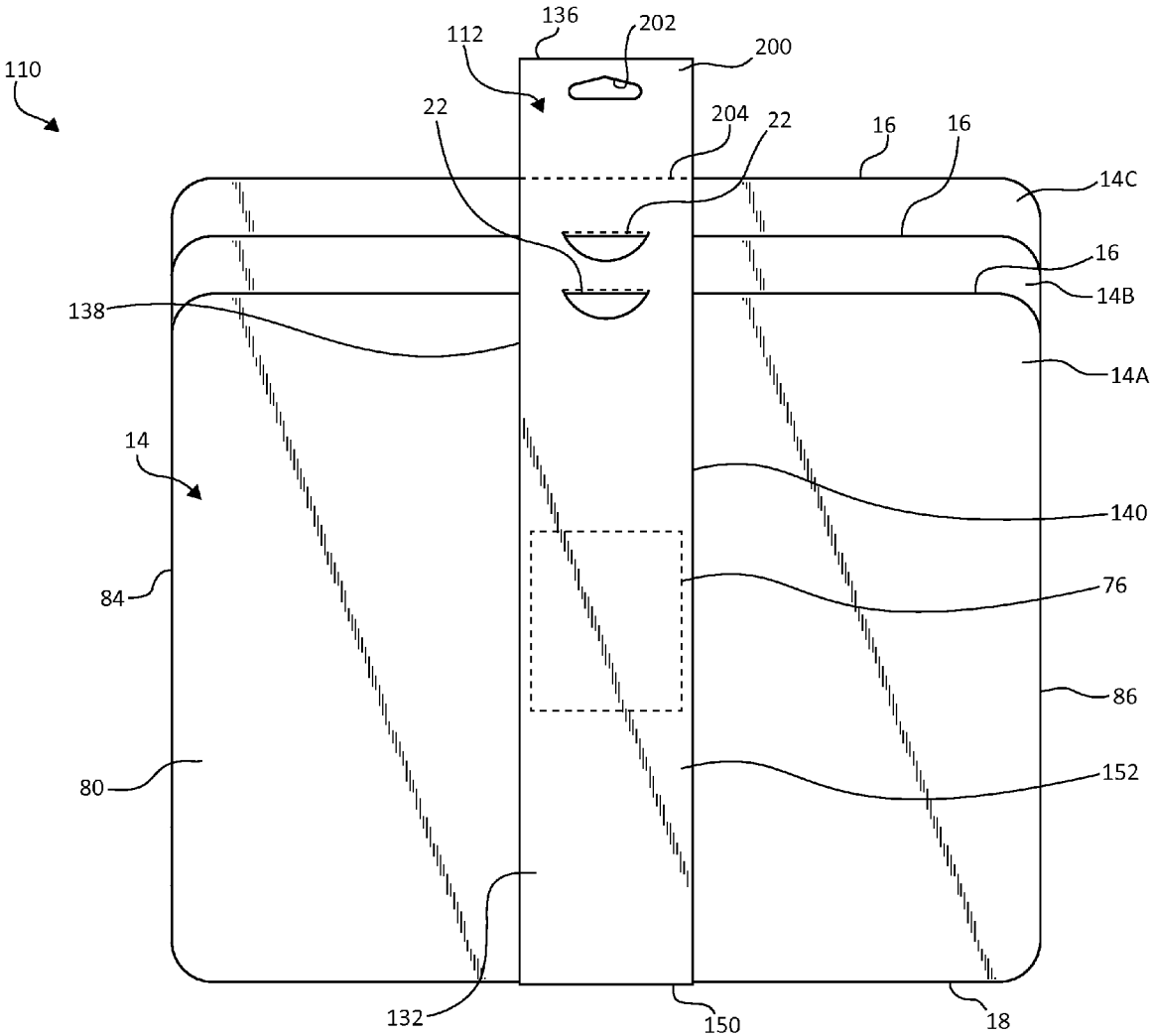
FIG. 12 is a front view illustration of the packaged product of FIG. 11, according to one embodiment of the present invention.
Figure 13:
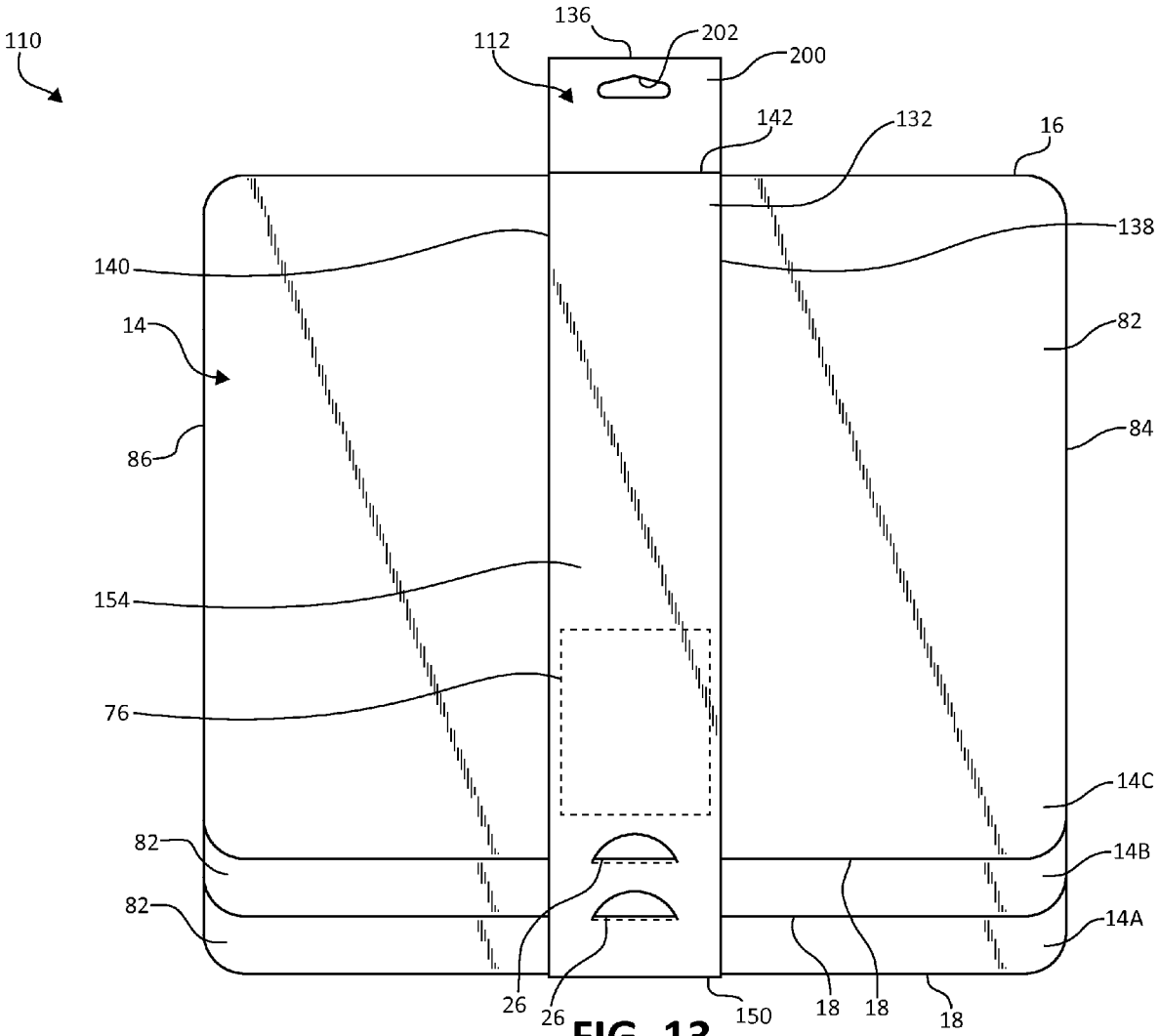
FIG. 13 is a rear view illustration of the packaged product of FIG. 11, according to one embodiment of the present invention.
Figure 15:
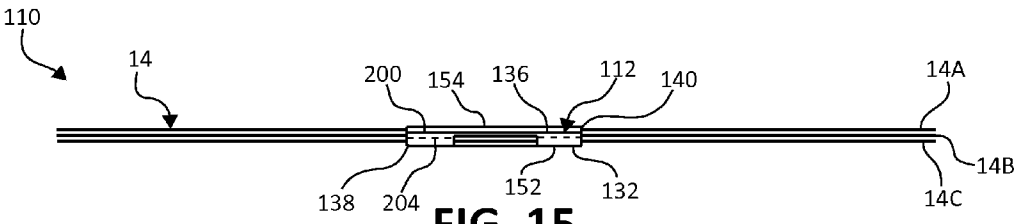
FIG. 15 is a top view illustration of the packaged product of FIG. 11, according to one embodiment of the present invention.
Figure 16:
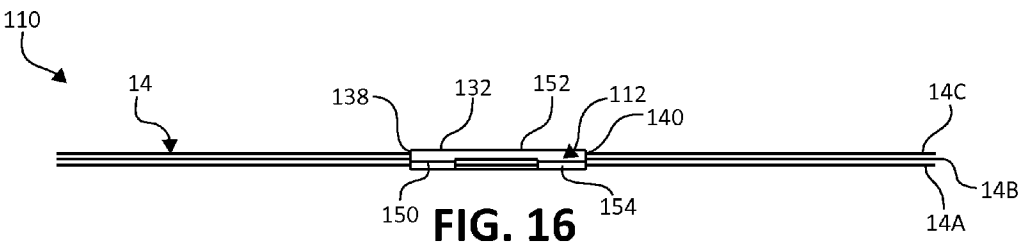
FIG. 16 is a bottom view illustration of the packaged product of FIG. 11, according to one embodiment of the present invention.
Figure 14:
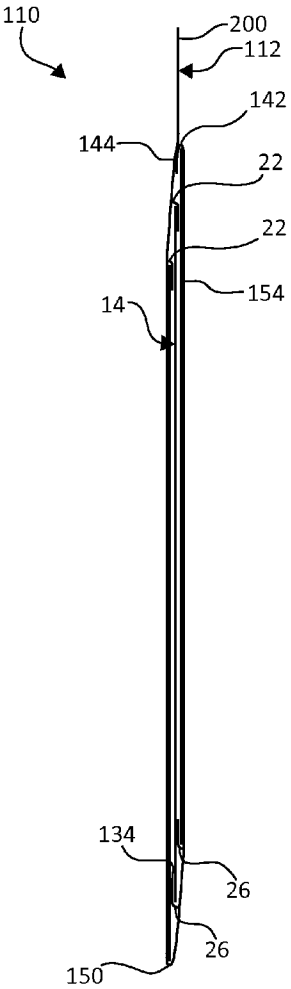
FIG. 14 is a right side view illustration of the packaged product of FIG. 11 with the left side view being a mirror image to the right side view, according to one embodiment of the present invention.

Additionally referring to FIG. 10, subsequently, bottom edge 18 of second product 14B is slid between one of front securement tabs 22 adjacent the topmost one of front securement tabs 22 (e.g., as illustrated, the bottommost one of front securement tabs 22) until bottom edge 18 rests near and substantially directly adjacent front panel fold line 56 of the corresponding one of front securement tabs 22. In this manner, bottom edge 18 of first product 14B is held between a corresponding front securement tab 22 and a remainder of front panel 52. When so positioned, in one example, top edge 16 of second product 14B is positioned below top edge 16 of first product 14A. Bottom edge 18 of third product 14C is positioned adjacent tab fold line 42 such that third product 14C lies over first and second products 14A and 14B and front panel 52 of packaging band 12. In this position, front surface 80 of third product 14C contacts rear surface 82 of second product 14B, front surface 80 of second product 14B contacts rear surface 82 of first product 14A, and front surface 80 of first product 14A contacts interior surface 30 of front panel 52 of packaged band 12. In one embodiment, a bottom portion of each of second product 14B and third product 14C adjacent corresponding bottom edges 18 also contact interior surface 30 of front panel 52 of packaged band 12.

Figure 9:
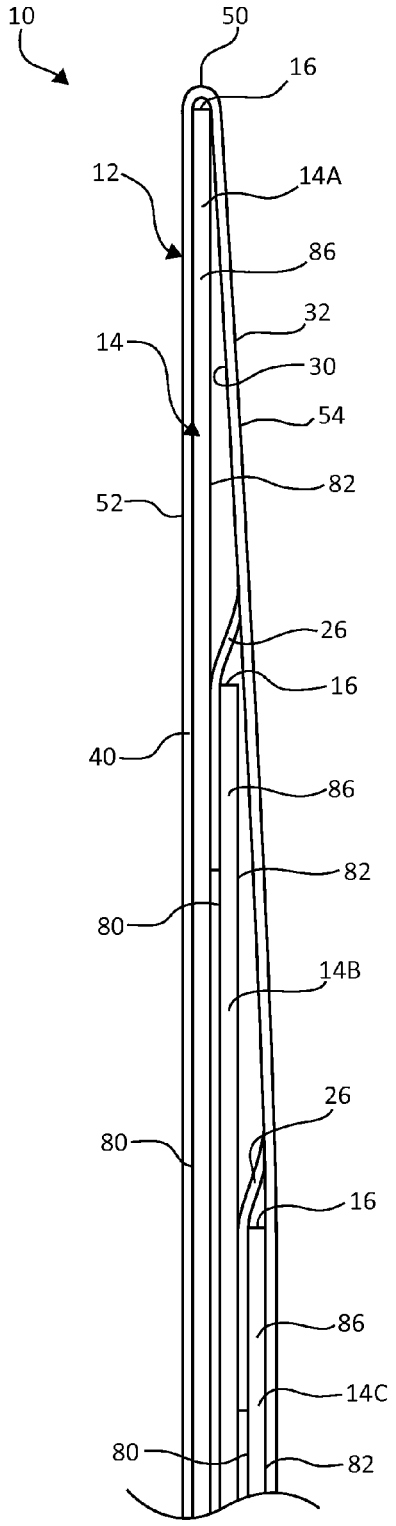
FIG. 9 is an enlarged top partial side view illustration of the packaged product of FIG. 1, according to one embodiment of the present invention.

Once products 14A, 14B, and 14C are properly positioned, e.g., as described above, coupling tab 44 is folded about tab fold line 42 upwardly and/or over third product 14C. Rear panel 54 is folded about divider fold line 50 over products 14A, 14B, and 14C. In one example, as rear panel 54 is folded about divider fold line 50 second product 14B and third product 14C are successively lifted slightly near top edges 16 so a corresponding top securement tab 22 can be slid under the respective second product 14B or third product 14C as illustrated, for example, with additional reference to FIG. 9. Adhesive 46 is applied to coupling tab 44, if not previously applied thereto, and rear panel 54 continues to rotate until a portion of interior surface 30 formed by rear panel 54 near second free end edge 36 contacts adhesive 46 on coupling tab 44 to secure the two parts of packaging band 12 together. In one example, rear panel 54 and first panel 52 are substantially similar in size and shape and second free end edge 36 is positioned immediately adjacent tab fold line 42 creating a clean appearance of the resultant packaged product 10.

When ends of packaging band 12 are secured to one another, products 14 are each secured within packaging band 12 via a combination of one of front securement tabs 22 and either one of second securement tabs 26 or placement adjacent divider fold line 50 or one of second securement tabs 26 and placement adjacent tab fold line 42. Although described as having front securement tabs 22 positioned nearer tab fold line 42 than divider fold line 50 and second securement tabs 22 positioned nearer divider fold line 50, in other embodiments, the opposite may be true provided front securement tabs 22 and rear securement tabs 26 are positioned opposite one another and are open toward one another upon folding and assembly of packaging band 12. In one example, front securement tabs 22 and rear securement tabs 26 are similar in size and shape and/or are all orientated in a substantially identical direction when packaging band 12 is unfolded (see, e.g., FIGS. 7 and 8).

By using a relatively thin packaging band 12 as compared to an overall width of products 14, e.g., having a width less than about 50% a width of products 14, or a width less than about 25% a width of products 14, a substantial portion of products 14 remain exposed allowing potential consumers to fully examine a thickness, quality, texture, flexibility, etc. of each of products 14 before purchase. Packaging band 12 also provides a non-obstructive yet aesthetically pleasing manner of presenting information about products 14. While specific embodiments of packaging band 12 and associated products 14 are described herein, other embodiments and/or variations will be apparent to those of skill in the art upon reading this application.

FIGS. 11-16 illustrate one embodiment of a packaged product 110 including packaging band 112 and products 14 substantially identical to those described above with packaged product 10. Packaging band 112 functions substantially similar to packaging band 12, but includes an extended flap 200 with a hanging aperture 202 to facilitate hanging packaged product 110 from a support rod or other supporting fixture if desired.

Figure 17:
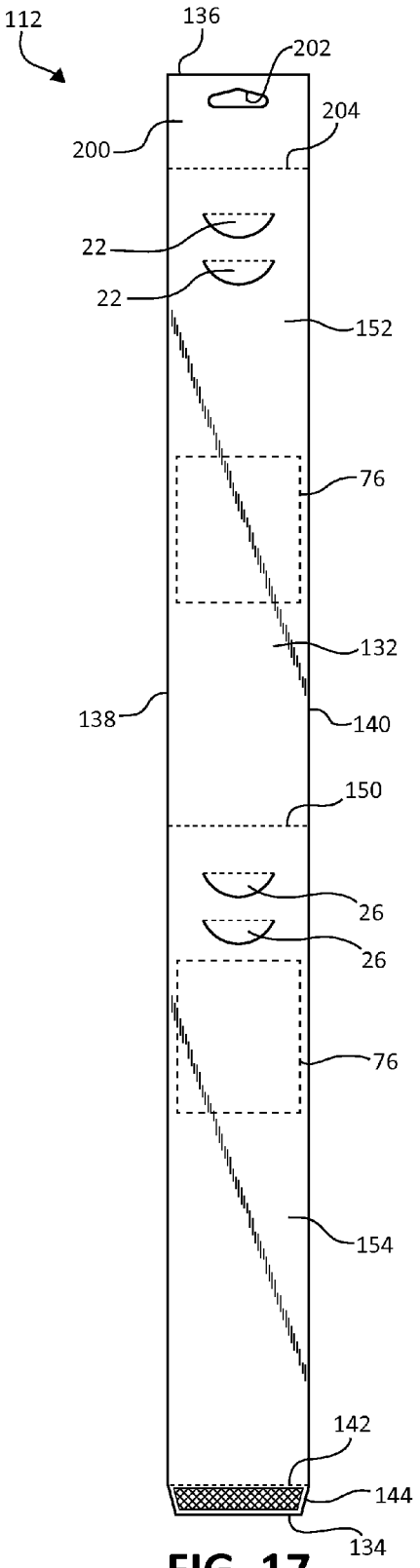
FIG. 17 is a front view illustration of an unfolded packaging band, according to one embodiment of the present invention.
Figure 18:
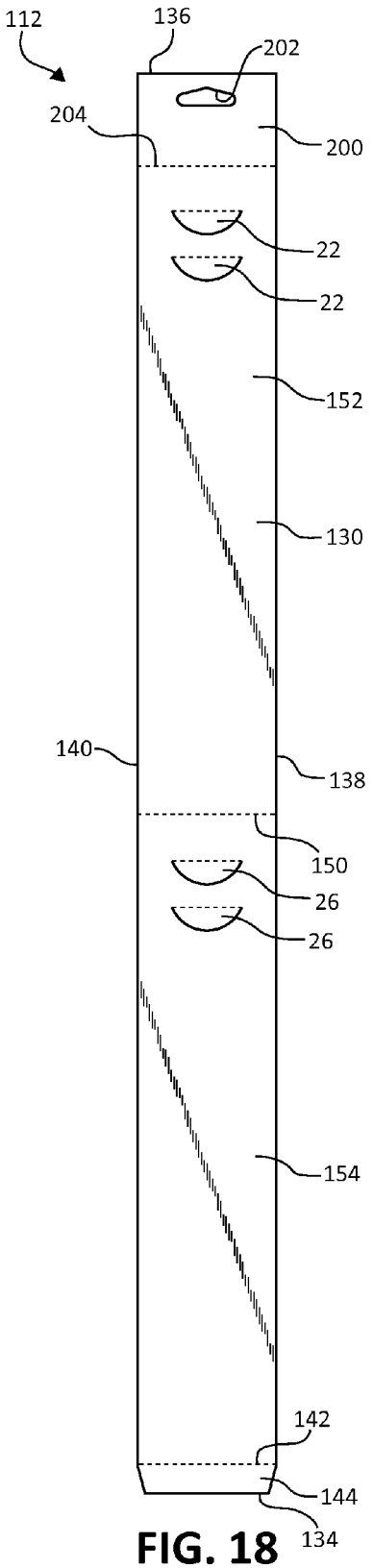
FIG. 18 is a rear view illustration of the unfolded packaging band of FIG. 17, according to one embodiment of the present invention.

FIGS. 17 and 18 illustrate packaging band 112 in an unfolded or initial state. In one embodiment, packaging band 112 is cut from a single piece of a suitable and foldable planar material such as paperboard, cardboard, plastic, etc. in an elongated shape, such as a rectangular shape. As a substantially planar member, packaging band 112 defines an interior surface 130, exterior surface 132 opposite interior surface 130, a first free end edge 134, a second free end edge 136 opposite first free end edge 134, and longitudinal side edges 138 and 140. Longitudinal side edges 138 and 140 each extend between first free end edge 134 and second free end edge 136 opposite one another. In one example, first free end edge 134 and second free end edge 136 extend substantially parallel to one another and/or substantially perpendicular relative to longitudinal side edges 138 and 140. In an embodiment, longitudinal side edges 138 and 140 extend substantially parallel to one another and/or substantially perpendicularly relative to first free end edge 134 and second free end edge 136.

A tab fold line 142 transversely extends across packaging band 112 near first free end edge 134 to define a coupling tab 144 therebetween. In one example, tab fold line 142 extends substantially parallel to first free end edge 134 and/or longitudinal side edges 138 and 140 taper toward one another as they near first free end edge 134. Adhesive 46, as indicated with hatching in FIG. 17, is applied to a portion of exterior surface 132 defined by coupling tab 144 to facilitate assembly of packaged product 110 of FIGS. 1-6. A divider fold line 150 extends transversely across packaging band 112 about midway between tab fold line 142 and second free end edge 136 to divide packaging band 112 into a first or front panel 152 and a second or rear panel 154.

In one embodiment, extended flap 200 coplanarly extends from a front panel end 204 of front panel 152 defined opposite divider fold line 150 to second free end edge 13. Front panel end 204 is located a substantially identical distance away from divider fold line 150 as tab fold line 142 but in an opposite direction. In one example, front panel 152 and rear panel 154 are substantially identical in length. Notably, while front panel end 204 is shown in FIGS. 17 and 18, in one embodiment, front panel end 204 is not physically visible other than being a location at which coupling tab 144 is received and that serves as a boundary between what is described herein as front panel 152 and extended flap 200.

Packaging band 112 includes front securement tabs 22 formed within an interior of front panel 152 and rear securement tabs 26 formed in rear panel 154 by rear panel cutouts 152 substantially identically to but in a different location and/or direction than packaging band 12. Front securement tabs 22 are each formed in front panel 152 near front panel end 204 to open or pull away from a remainder of front panel 152 toward divider fold line 150. Rear panel cutouts 24 are each formed near divider fold line 150 to open or pull away from a remainder of rear panel 154 toward tab fold line 142. In this manner, as shown in the illustrated embodiment of FIGS. 17 and 18, when package band 112 is unfolded, front securement tabs 22 and rear securement tabs 26 all open in the same general direction (e.g., downwardly as illustrated) away from a respective one of front panel end 204 and divider fold line 150. In one example, external surface 132 further includes indicia, as generally indicated by dashed boxes 76 in FIGS. 11-17, similar to packaging band 12 on one or both of front panel 152 and rear panel 154.

Figure 19:
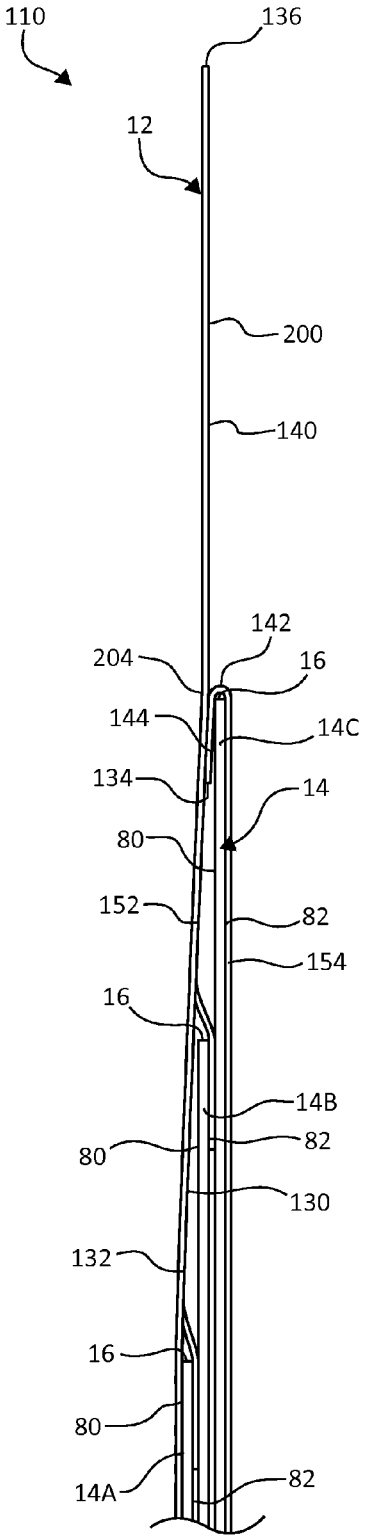
FIG. 19 is an enlarged top partial side view illustration of the packaged product of FIG. 11, according to one embodiment of the present invention.

During assembly, each of products 14 is secured to packaging band 112 via at least one of front securement tabs 22 and rear securement tabs 26. More specifically, in one embodiment, packaging band 112 is placed on a support surface (not shown) such as a table with exterior surface 54 down as illustrated for example, in FIG. 18. Top edge 16 of first product 14A is slid between a bottommost one of front securement tabs 22 (e.g., the one of front securement tabs 22 closest to divider fold line 150) and a remainder of front panel 152, as illustrated, for example, with additional reference to FIG. 19. When so positioned, in one example, bottom edge 18 of first product 14A is positioned immediately adjacent divider fold line 150, such that a height of first product 14A is substantially equal to a distance between a top of the bottommost front securement tab 22 and divider line 50.

Subsequently, top edge 16 of second product 14B is slid between one of front securement tabs 22 adjacent the bottommost one of front securement tabs 22 (e.g., as illustrated, the topmost one of front securement tabs 22) and a remainder of front panel 152. When so positioned, in one example, bottom edge 18 of second product 14B is positioned below top edge 16 of first product 14A. Bottom edge 18 of third product 14C is positioned adjacent top panel end 204 such that third product 14C lies over first and second products 14A and 14B and front panel 152 of packaged band 112. In this position, front surface 80 of third product 14C contacts rear surface 82 of second product 14B, front surface 80 of second product 14B contacts rear surface 82 of first product 14A, and front surface 80 of first product 14A contacts interior surface 130 of front panel 52 of packaging band 12. In one embodiment, a top portion of each of second product 14B and third product 14C adjacent corresponding top edges 16 also contact interior surface 130 of front panel 152 of packaged band 12.

Figure 20:
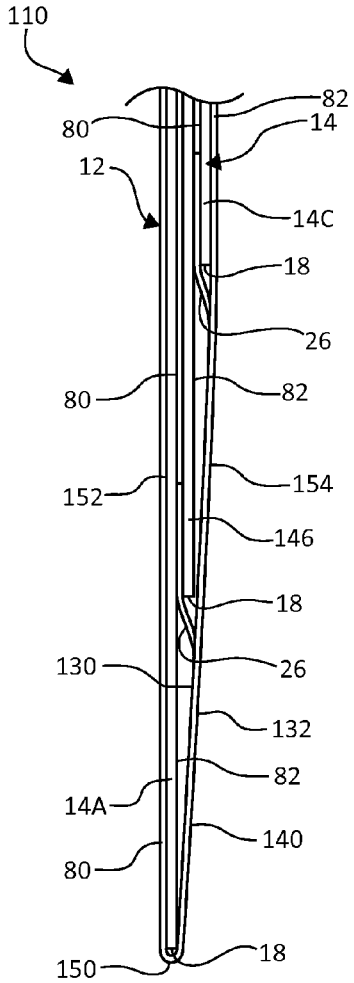
FIG. 20 is an enlarged bottom partial side view illustration of the package product of FIG. 11, according to one embodiment of the present invention.

Once products 14A, 14B, and 14C are properly positioned, e.g., as described above, rear panel 154 is folded about divider fold line 150 over products 14A, 14B, and 14C. In one example, as rear panel 154 is folded about divider fold line 150 second product 14B and third product 14C are successively lifted slightly near bottom edges 18 so that a corresponding one of rear securement tabs 26 can be slid under the respective second product 14B or third product 14C as illustrated, for example, with additional reference to FIG. 20. Adhesive 46 is applied to a portion of exterior surface 132 of coupling tab 144, if not previously applied thereto, and rear panel 154 continues to rotate toward front panel 152. Coupling tab 144 is carefully folded around top edge 16 of third product 14C. Rear panel 152 is then further rotated until adhesive 46 on coupling tab 44 contacts a portion of interior surface 130 formed by front panel 152 adjacent front panel end 204 to secure the two panels 152 and 154 of packaging band 112 together opposite divider fold line 150. In one example, second panel 154 and first panel 152 are substantially similar in size and shape and/or second front panel end 204 is positioned immediately adjacent tab fold line 42 creating a clean appearance of the resultant packaged product 110. The resultant packaging band 112 holds products 14 of packaged product 110 in place in an aesthetically pleasing manner as described for packaging band 12 and packaged product 10 (FIGS. 1-8).

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A packaging band comprising:

two opposing side edges;

a divider fold line extending between and contacting each of the two opposing side edges;

a front panel extending in a first direction away from the divider fold line;

a rear panel extending in a second direction away from the divider fold line;

a front securement tab formed in an interior of the front panel and being configured to flex relative to a remainder of the front panel about a front panel fold line;

a rear securement tab formed in an interior of the rear panel and being configured to flex relative to a remainder of the rear panel about a rear panel fold line; and a coupling tab directly secured to one of an end of the front panel opposite the rear panel and an end of the rear panel opposite the front panel, wherein the coupling tab is folded and directly secured to the other one of the end of the front panel opposite the rear panel and the end of the rear panel opposite the front panel, wherein:

the front securement tab and the rear securement tab each flex about a corresponding one of the front panel fold line and the rear panel fold line relative to a respective one of the remainder of the front panel and the remainder of the rear panel to open toward a same one of the first direction and the second direction when the packaging band is unfolded about the divider fold line and laid substantially flat.

2. The packaging band of claim 1, wherein the packaging band is formed as a single piece of a substantially planar material.

3. The packaging band of claim 1, wherein each of the front panel and the rear panel are positioned immediately adjacent the divider fold line.

4. The packaging band of claim 1, wherein:

the front securement tab is one of a number of front securement tabs, the rear securement tab is one of a number of rear securement tabs, and the number of front securement tabs equals the number of rear securement tabs.

5. The packaging band of claim 1, further comprising an extension tab extending from one of the front panel and the rear panel opposite the divider fold line and including a hanging aperture formed therethrough.

6. The packaging band of claim 1, wherein the packaging band is folded about the divider fold line and the front panel is directly secured to the rear panel opposite the divider fold line.

7. The packaging band of claim 6, wherein when the packaging band is folded about the divider fold line, the front securement tab opens toward the rear securement tab and the rear securement tab opens toward the front securement tab.

8. The packaging band of claim 1, wherein the front securement tab is coupled to a remainder of the front panel only along the front panel fold line, and the second securement tab is coupled to a remainder of the rear panel only along the rear panel fold line, and the front panel fold line, the rear panel fold line, and the divider fold line extend substantially parallel to one another.

9. The packaging band of claim 1, in combination with a first product, wherein:

the first product defines a first edge and a second edge opposite the first edge, the first edge of the first product is secured between the front securement tab and the front panel, and the second edge of the first product is positioned between the front panel and the rear panel and is positioned one of adjacent the divider fold line and adjacent ends of the front panel and the rear panel opposite the divider fold line.

10. The combination of claim 9, further including a second product, wherein:

the second product defines a first edge and a second edge opposite the first edge of the second product, the first edge of the second product is positioned between the front panel and the rear panel and is positioned between the other one of adjacent the divider fold line and adjacent ends of the front panel and the rear panel opposite the divider fold line, the second edge of the second product is secured between the rear securement tab and the rear panel, and the second product is stacked on and directly abuts the first product between the first edge and the second edge of the second product.

11. The combination of claim 10, further comprising a third product, wherein:

the front securement tab is a first front securement tab, the rear securement tab is a first rear securement tab, the packaged product includes a second front securement tab formed in the front panel and a second rear securement tab formed in the rear panel, the third product defines a first edge and a second edge opposite the first edge of the third product, the first edge of the third product is secured between the second front securement tab and the front panel, and the second edge of the third product is secured between the second rear securement tab and the rear panel.

12. The combination of claim 11, wherein the second rear securement tab is positioned a first distance away from the first rear securement tab and the first distance away from an end of one of the front panel and the rear panel.

13. The combination of claim 9, wherein:

the first product defines two side edges each extending from the first edge to the second edge of the first product opposite one another, and the packaging band has a width, defined between the two opposing side edges of the packaging band, that is about 50% or less of a width of the first product as defined between the two side edges of the first product.

14. The combination of claim 9, further comprising a second product, wherein:

the first product and the second product are ones of a number of products included in the combination, the front securement tab includes a number of front securement tabs, and the number of front securement tabs equals one less than the number of products.

15. A packaged product comprising:

two or more substantially planar products each defining opposing edges;

a packaging strip folded to encircle the two or more substantially planar products in a manner defining a first panel on one side of the two or more substantially planar products and a second panel on an opposite side of the two or more substantially planar products, wherein:

the first panel defines at least one first internal cutout, the second panel defines at least one second internal cutout, the at least one first internal cutout extends from a first fold line toward the at least one second internal cutout, the at least one second internal cutout extends from a second fold line, which is entirely spaced away from the first panel, toward the at least one first internal cutout, the at least one first internal cutout receives one of the opposing edges of a first one of the two or more substantially planar products, the at least one second internal cutout receives one of the opposing edges of a second one of the two or more substantially planar products, a first end of the first panel is coupled to a first end of the second panel via a fold line, and a second end of the first panel is coupled to a second end of the second panel via adhesive.

16. The packaged product of claim 15, wherein the packaging strip is formed as a single piece of a substantially planar member.

17. The packaged product of claim 15, wherein the other of the opposing edges of the first one of the two or more substantially planar products is maintained adjacent one of the fold line and the first end of the first panel.

18. The packaged product of claim 17, wherein:

the two or more substantially planar products includes a third product, the third product includes opposing edges respectively maintained between a different one of the at least one first internal cutout and a different one of the at least one second internal cutout.

19. A method of assembling a packaged product, the method comprising:

providing a packaging band having a first panel opposite a second panel, wherein a divider fold line separates and borders each of the first panel and the second panel, the packaging band defines a first securement tab within an interior the first panel and a second securement tab within an interior of the second panel;

securing a first edge of a first substantially planar product between one of the first securement tab and the second securement tab and a corresponding one of the first panel and the second panel;

securing a second edge of a second substantially planar product between the other one of the first securement tab and the second securement tab and the other corresponding one of the first panel and the second panel;

folding the packaging band about the divider fold line such that an interior surface of the first panel faces an interior surface of the second panel, wherein upon folding the packaging band, the second edge of the first substantially planar product is maintained between the front panel and the second panel immediately adjacent the divider fold line; and securing an end of the first panel opposite the divider fold line to an end of the second panel opposite the divider fold line such that the end of the first panel opposite the divider fold line and the end of the second panel opposite the divider fold line are immediately adjacent one another, wherein the first edge of the second substantially planar product is secured between the first panel and the second panel adjacent the end of the first panel secured to the end of the second panel.

20. The method of claim 19, wherein:

the packaging band includes:

a third securement tab within the interior of the first panel and flexing to open toward the second securement tab, and a fourth securement tab within the interior of the second panel and flexing to open toward the third securement tab, and the method further comprises securing a first edge of a third substantially planar product between the third securement tab and the first panel and securing a second edge of the substantially planar product between the fourth securement tab and the second panel, wherein the second edge of the substantially planar product is opposite the first edge of the third substantially planar product, and the third substantially planar product is positioned between the first substantially planar product and the fourth substantially planar product.

21. The packaging band of claim 1, wherein the rear panel fold line is spaced in the second direction away from the divider fold line.

22. The packaging band of claim 21, wherein each of the front panel and the rear panel extend between and terminate at the two opposing side edges, and the two opposing side edges are substantially linear and substantially parallel to each other.

23. The packaging band of claim 21, wherein:

the front securement tab is defined by and extends between the front panel fold line and a first arcuate cut extending from opposing ends of the front panel fold line within the interior of the front panel, and the rear securement tab is defined by and extends between the rear panel fold line and a second arcuate cut extending from opposing ends of the rear panel fold line within the interior of the rear panel.

* * * * *